United States Patent [19]

Cremer

[11] Patent Number: 4,546,710

[45] Date of Patent: Oct. 15, 1985

[54] BURNER HEAD

[75] Inventor: Jens Cremer, Kalmar, Sweden

[73] Assignee: Euronom AB, Kalmar, Sweden

[21] Appl. No.: 509,449

[22] PCT Filed: Oct. 13, 1982

[86] PCT No.: PCT/SE82/00332

§ 371 Date: Jun. 14, 1983

§ 102(e) Date: Jun. 14, 1983

[87] PCT Pub. No.: WO83/01497

PCT Pub. Date: Apr. 28, 1983

[30] Foreign Application Priority Data

Oct. 20, 1981 [SE] Sweden ..... 8106197

[51] Int. Cl.[4] ..... F23G 7/00; F24D 1/02

[52] U.S. Cl. ..... 110/263; 110/264; 110/265

[58] Field of Search ..... 110/260, 261, 263, 264, 110/265, 244

[56] References Cited

U.S. PATENT DOCUMENTS

| | | | |
|---|---|---|---|
| 1,910,735 | 5/1933 | Zikesch | 110/264 |
| 2,738,776 | 3/1956 | Burg | 110/264 |
| 3,309,866 | 3/1967 | Kydd | 110/264 |
| 3,513,788 | 5/1970 | Ostrin | 110/246 |
| 3,837,303 | 9/1974 | Baardson | 110/244 |
| 4,096,808 | 6/1978 | Trickel | 110/264 |
| 4,147,116 | 4/1979 | Graybill | 110/264 |
| 4,252,069 | 2/1981 | McCartney | 110/265 |
| 4,304,196 | 12/1981 | Chadshay et al. | 110/263 |
| 4,351,251 | 9/1982 | Brashears | 110/264 |

*Primary Examiner*—Henry C. Yuen

*Attorney, Agent, or Firm*—LeBlanc, Nolan, Shur & Nies

[57] ABSTRACT

A burner head for combusting solid fuels such as straw, peat, chips, coal etc., comprising a charging opening (11) for the fuel and a discharge opening (15) for flue gases. According to the invention the burner head (1) is characterized in that it comprises two pipes (6,7) located concentrically to each other, where the gap (8) between the pipes is intended to communicate with a supply source for combustion air and communicates with the interior of the inner pipe (7) via apertures in the wall thereof. A plurality of apertures (12,13) are located a distance from the charging opening (11) to form a first combustion zone, and a plurality of apertures (14) are located a distance from said firstmentioned apertures (12,13) and closer to the discharge opening (15) to form a second combustion zone. In the first combustion zone the fuel is intended to be combusted incompletely. The gases produced thereby are intended to be combusted completely in the second combustion zone. According to a preferred embodiment additional apertures (16,17) are located close to the discharge opening (15).

3 Claims, 3 Drawing Figures

BURNER HEAD

This invention relates to a burner head for the combustion of solid fuels, primarily such solid fuels as, for example, wood chips, straw, peat or coal, but also other solid fuels can be used.

At the combustion of solid fuels of the aforesaid kind, the combustion normally takes place openly, i.e. with free air access to the fireplace. It is further usual at the combustion of material such as chips, straw and peat to transport the material upward by means of a conveyor to an upwardly/outwardly widening combustion vessel where the combustion takes place with free air access to the vessel. Such combustion implies that the combustion in most cases is incomplete and, therefore, uncombusted gases develop and are removed. Known installations, moreover, are relatively bulky.

The present invention solves these problems, because a substantially complete combustion takes place by means of the burner head, which besides is relatively small.

It has been desired to be able to fire conventional boilers in one-family houses with the solid fuels stated above. The burner head according to the invention is extremely well suited for such boilers.

The present invention, thus, relates to a burner head for combusting solid fuels such as straw, peat, chips, coal etc., comprising a charging opening for the fuel and a discharge opening for flue gases. The invention is characterized in that the burner head comprises two pipes located concentrically to each other, where the gap between the pipes is intended to communicate with a supply source for combustion air and communicates with the interior of the inner pipe via apertures in the wall of said pipe, and a plurality of apertures are located some distance from the charging opening to form a first combustion zone, at which the fuel is intended to be combusted incompletely, and a plurality of apertures are located some distance from said firstmentioned apertures and closer to the discharge opening to form a second combustion zone, at which incompletely combusted gases from the first combustion zone are intended to be combusted completely.

The invention is described in greater detail in the following, with reference to the accompanying drawing, in which an embodiment is shown.

Figure 1:
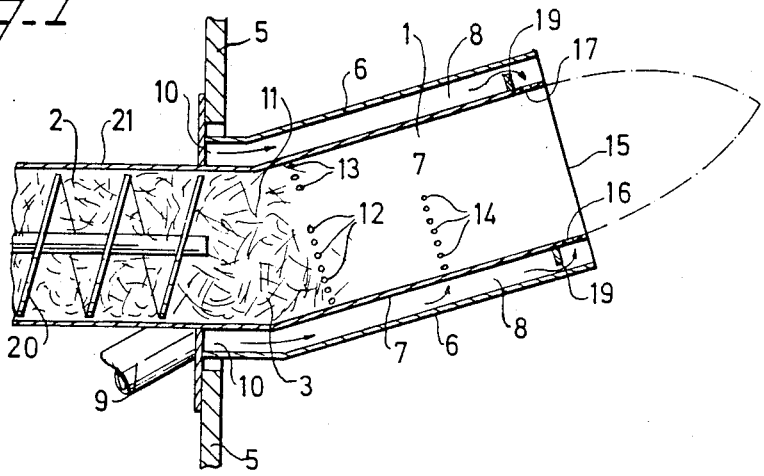
Figure 2:
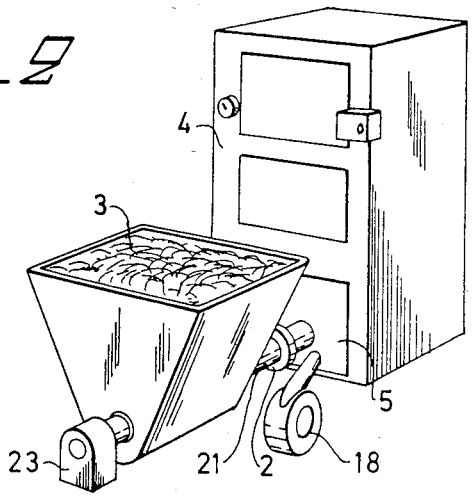
Figure 3:
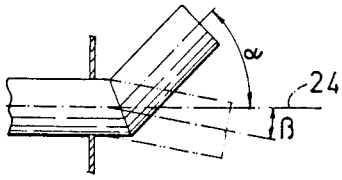

FIG. 1 is a schematic cross-section of a burner head according to the invention, FIG. 2 shows an installation, in which the burner head is used, and FIG. 3 shows different alternative locations of the burner head relative to the horizontal plane.

FIG. 1 is a schematic cross-section of a burner head 1 and an associated charging means 2. As example a solid fuel 3, such as straw, is shown schematically.

The burner head 1 preferably is placed in a boiler 4 or the like, see FIG. 2, which is indicated also in FIG. 1 by means of a section of the front wall 5 of the boiler 4.

The burner head 1 comprises two pipes 6,7 located concentrically to each other. The gap 8 between the pipes 6,7 communicates with a supply source for combustion air via a channel 9, which in the rear portion of the burner head is connected to a space 10 with annular cross-section between the pipes 6,7 at the charging opening 11 of the burner head 1.

The gap 8 further communicates with the interior of the inner pipe 7 via apertures in the wall of the pipe 7.

Said apertures are located in at least and preferably two places along the longitudinal axis of the burner head 1, whereby at least two combustion zones are formed in the burner head 1.

According to a preferred embodiment a plurality of apertures in the form of a series of holes are located some distance from the charging opening 11 to form a first combustion zone. The holes 12,13 are placed uniformly along the periphery of the inner pipe 7 in one or several groups. In FIG. 1 two groups 12,13 of such holes are shown, which groups cover a large part of the circumference of the inner pipe 7. There are further provided a plurality of apertures in the form of holes 14 some distance from said firstmentioned holes 12,13 and closer to the discharge opening 15 of the burner head to form a second combustion zone.

According to a preferred embodiment an additional aperture or additional apertures 16,17 are located close to the discharge opening 15 to form a third combustion zone. An annular throttling 19 close to said lastmentioned apertures 16,17 is provided to control charged air amount so that only a small part thereof flows out through said lastmentioned apertures 16,17.

The supply source for combustion air consists of an electrically operated fan 18, which in known manner is capable to inject an air amount adjusted to the combustion in relation to charged fuel.

The fuel 3 is solid and preferably consists of straw, peat, wood chips or coal etc. As regards wood chips, so-called pellets have proved suitable.

The dimensions of the burner head are relatively small. The following example can be mentioned for a burner head 1 intended for a boiler in a one-family house. The length of the burner head 1 is about 200 mm, and its outer diameter is about 140 mm. The outer diameter of the inner pipe 7 is about 105 mm. The height of the gap 8, thus, is about 30–35 mm.

The first group 12 of holes comprises ten holes, and the second group 13 comprises six holes. The additional holes 14 are ten in number. The holes 12,13,14 have a diameter of about 5 mm and are located in the circumferential direction of the inner pipe with a mutual division of 18°.

The holes of the first group 12 and second group 13 are located about 30 mm spaced from the charging opening 11 of the burner head 1, and the additional holes 14 are located about 100 mm spaced from the charging opening 11.

The pipes 6,7 preferably are made of stainless steel, but other materials, of course, can be imagined.

The charging device 2 preferably consists of a conventional screw conveyor, comprising a screw 20 enclosed by a tubular drum 21 which is capable to feed the solid fuel 3 from a vessel 22 to the charging opening 11 of the burner head 1. The screw 20 is operated by an electric motor 23.

The feed of the fuel 3 by the screw conveyor 2 preferably takes place in intermittent steps, but also can take place continuously, and passes into and fills or packs the charging opening 11 to form a wall of solid fuel 3 at the charging opening part of inner pipe 7 as shown in FIG. 1.

The function of the burner head 1 is as follows. Solid fuel 3 is fed to the charging opening 11 and advanced to the first groups of holes 12, 13, through which, subsequent to the ignition of the fuel, air flows in and maintains the combustion.

In this combustion zone the fuel is combusted incompletely, so that reducing gases, a.o. carbon monoxide (CO) and hydrocarbons ($CH_x$) are formed. The reducing combustion gases thus formed flow out in the direction to the discharge opening 15 and are finally combusted at the mixture with air, which flows in via the holes 14, whereby a.o. Co is oxidized to $CO_2$. In order to prevent uncombusted substances to be included in the flue gases, preferably an additional amount of air is passed in through the holes or apertures 16,17 so that substances are combusted which were not combusted after the second combustion zone.

The amount of air supplied to the different combustion zones, of course, must be controlled depending on the type of fuel charged and depending on the amount of fuel charged. Such controlled adjustment is not difficult, but can be carried out by the expert on the basis of the dimensions stated above, which refer to wood chip pellets.

By utilizing two combustion zones, in addition to a complete combustion a relatively low temperature is obtained in the first combustion zone. A low temperature is favourable, because the formation of liquid alkaline slags and silicon oxides is oppressed. The gases developed in the first combustion zone flow out to the second combustion zone at strong turbulence, so that their mixture with air and thereby the combustion in the second combustion zone is very efficient.

The arrangement of air supply between two concentrically located pipes 6,7 implies, that the inner pipe 7 is cooled and that the combustion air to the second and third combustion zones is preheated, which is favourable for the combustion.

It was found by experiments and test runs that a substantially complete combustion of the fuel takes place, which yields a very high efficiency degree of the installation.

The ashes formed during the combustion are ejected or flow out of the burner head and collect on the bottom of the boiler 5.

Depending on the fuel type, the burner head is designed angular to the horizontal plane. In FIG. 1 the burner head is shown upward angular, i.e. with a positive angle to the horizontal plane. A positive angle is favourable for fuels of the chip pellets type, which otherwise tend to roll out of the burner head.

For fuels, of which liquid slags could be formed, the burner head preferably is directed downward, i.e. with a negative angle to the horizontal plane, but preferably not more than $-10°$ to the horizontal plane, so that the slags flow out of the burner head. For certain fuels, for which a considerable packing of the fuel in the rear portion of the burner head is favourable, the burner head is directed upward to as much as $+45°$ to the horizontal plane.

In FIG. 3 the burner head is shown by fully drawn lines forming an angle of $+45°$ ($\alpha$) and, respectively, by dashed lines forming an angle of $-10°$ ($\beta$) to the horizontal plane 24.

The present invention must not be regarded restricted to the embodiments described above, but can be varied within its scope defined by the attached claims.

The burner head, for example, can be designed for industrial operation with high effects, in which case the burner head will be modified within the scope of the invention.

I claim:

1. A burner head for combusting solid fuels such as straw, peat, chips, coal etc., comprising a charging opening (11) for the fuel and a discharge opening (15) for flue gases, where the burner head (1) comprises two tubes (6,7) located concentrically to each other, where the inner tube (7) forms a charging opening (11) for the fuel and a discharge opening (15) for flue gases, and where the gap (8) between the tubes is intended to communicate with a supply source (9,10,18) for combustion air and communicates with the interior of the inner tube (7) via apertues (12,13,14) in the wall thereof, characterized in that the inner tube is made of metallic material, such as steel, the charging opening (11) and the discharge opening (15) formed by the inner tube (7) have substantially the same diameter as the diameter of the inner tube (7), said apertures comprise a first plurality of apertures (12,13) located a distance from the charging opening (11) to form a first combustion zone, at which the fuel is intended to be combusted incompletely, and a second plurality of apertures (14) spaced from said first mentioned apertures at a location, closer to the discharge opening (15), which is substantially centrally disposed between the charging opening (11) of the burner head (1) and the discharge opening (15) thereof, to form a second combustion zone, at which gases combusted incompletely from the first combustion zone are intended to be combusted completely, and screw conveyor means having an outlet matching and connected to the inlet of said inner tube adjacent said first plurality of apertures for introducing solid fuel into the charging opening and filling the inner tube with solid fuel at the charging opening.

2. A burner head as defined in claim 1, characterized in that an additional aperture means (16,17) are located close to the discharge opening (15) to form a third combustion zone.

3. A burner head as defined in claim 1, characterized in that the geometric axis of the burner head (1) forms an angle of $+45°$ to $-10°$ to the horizontal plane, where positive angle refers to upward inclination of the burner head (1).

* * * * *